US007905205B1

(12) United States Patent
Parris

(10) Patent No.: US 7,905,205 B1
(45) Date of Patent: Mar. 15, 2011

(54) 2-STROKE ENGINE CRANK SHAFT

(76) Inventor: Steven M. Parris, Bozeman, MT (US)

( * ) Notice: Subject to any disclaimer, the term of this patent is extended or adjusted under 35 U.S.C. 154(b) by 506 days.

(21) Appl. No.: 12/214,254

(22) Filed: Jun. 17, 2008

Related U.S. Application Data

(60) Provisional application No. 60/961,824, filed on Jul. 24, 2007.

(51) Int. Cl.
*F02B 25/00* (2006.01)

(52) U.S. Cl. ..... 123/73 A; 123/197.1

(58) Field of Classification Search ..... 123/195 R, 123/197.1, 197.4, 65 R, 73 R–73 BA, 73 CC, 123/73 D, 73 DA, 73 PP, 73 V
See application file for complete search history.

(56) References Cited

U.S. PATENT DOCUMENTS 2,565,002 A * 8/1951 Scott ..... 123/73 V
4,248,185 A 2/1981 Jaulmes
4,362,132 A 12/1982 Neuman

* cited by examiner

*Primary Examiner* — Noah Kamen

(57) ABSTRACT

A two-cycle engine heaving a pair of disk wheel shaped counterweights attached to the crankshaft. The rims of the first and second counterweights provided with a plurality of parallel grooves arranged continuously around the circumference of the rims and extending from an outer edge to an inner edge of the rims. The grooves are angularly disposed with respect to an axis of rotation of the crankshaft and in a direction against the direction of rotation of the crankshaft. The grooves of the first counterweight are aligned with the grooves of the second counterweight whereby the corresponding grooves form a "V" configuration.

1 Claim, 3 Drawing Sheets

2-STROKE ENGINE CRANK SHAFT

This application claims the benefit of provisional application Ser. No. 60/961,824 filed Jul. 24, 2007.

BACKGROUND OF INVENTION

The present invention relates to a modified crank shaft for a 2-stroke engine. Crank counter weights attached to the crank shaft include peripheral grooves for directing a fuel/air mixture from the crank case toward the transfer ports of the engine cylinder resulting in increased fuel efficiency, power, and smooth operation.

Two-cycle engines utilizing a crank disk with a pocket for mechanically transferring a fuel charge from a crankcase to a combustion chamber is shown in U.S. Pat. No. 4,362,132 to Newman.

The present invention is directed to a modified crankshaft used with a two-cycle engine which continuously directs an optimized volume of fuel/air mixture from the crankcase to the combustion chamber.

SUMMARY OF INVENTION

The present invention utilizes modified counterweights attached to the crankshaft of a two-cycle engine. Two similarly shaped counterweights are conventionally attached to the crankshaft for connecting the crankshaft with a connecting rod. The counterweights of the present invention have a disk wheel shape. Each disk wheel having a rim. The rim of a first counterweight is provided with a plurality of parallel grooves arranged continuously around the circumference of the disk wheel and extend from an outer edge to an inner edge of the rim. The grooves are angularly disposed with respect to an axis of rotation of the crankshaft and in a direction against the direction of rotation of the crankshaft.

The rim of the second counterweight is provided with a plurality of parallel grooves arranged continuously around the circumference of the disk wheel and extend from an outer edge to an inner edge of the corresponding rim. The grooves are angularly disposed with respect to the axis of rotation of the crankshaft and in a direction against the direction of rotation of the crankshaft.

The grooves of the first counterweight are aligned with the grooves of the second counterweight whereby the corresponding grooves form a "V" configuration.

With this construction of the counterweights the grooves tangentially throw a fuel/air mixture from the crankcase toward the transfer ports of the engine cylinder. The volume of the fuel/air mixture directed to the transfer ports and the forces exerted on the fuel/air mixture being directed to the transfer ports are significantly increased thereby optimizing the fuel/air mixture delivered to the combustion chamber. The result is enhanced fuel efficiency, power and smooth operation.

BRIEF DESCRIPTION OF THE DRAWINGS

In order that the invention may be clearly understood and readily carried into effect, a preferred embodiment of the invention will now be described, by way of example only, with reference to the accompanying drawings wherein.

DESCRIPTION OF A PREFERRED EMBODIMENT

Figure 1:
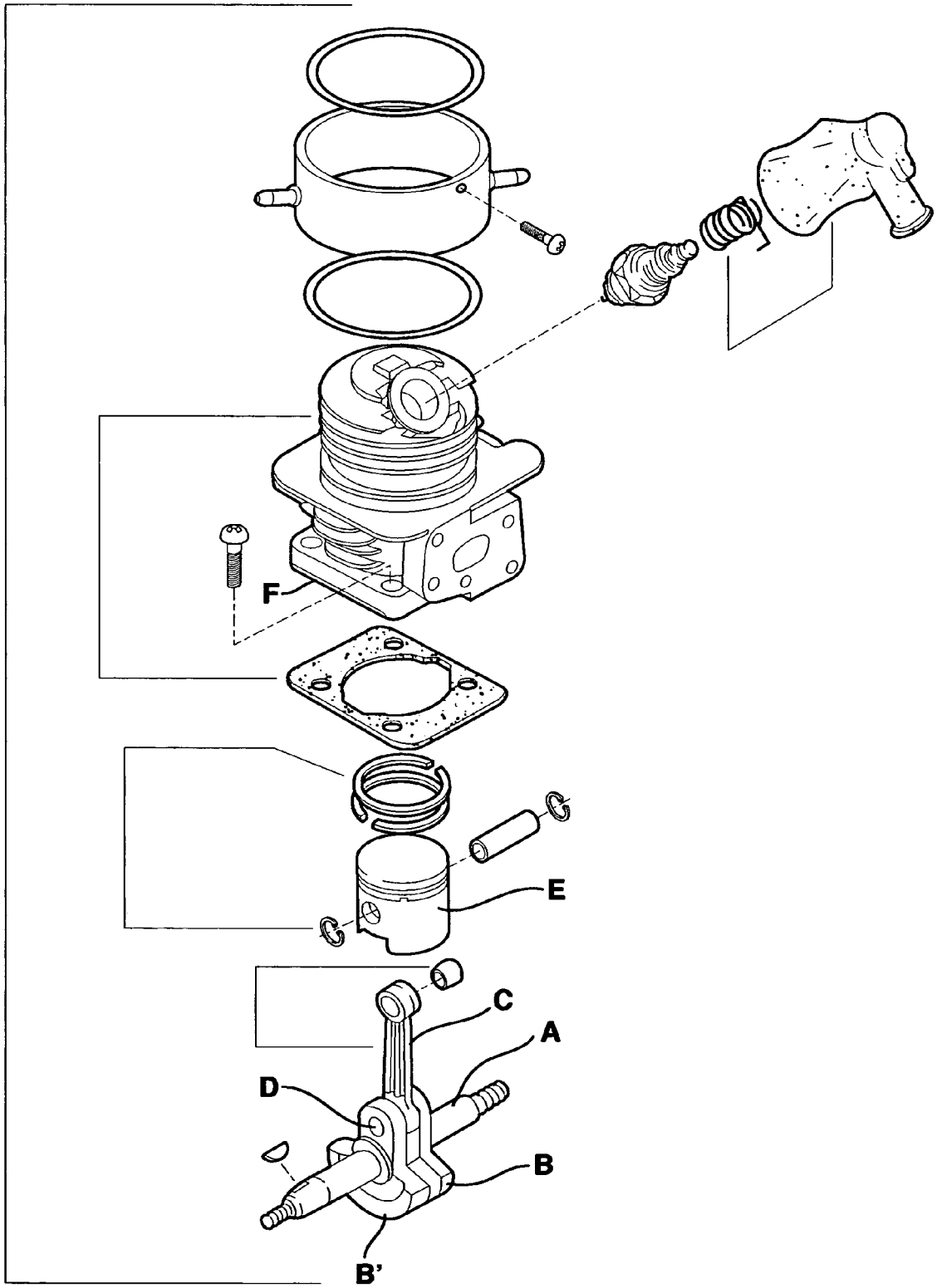
FIG. 1 is an exploded view of a conventional 2-stroke engine.

An exploded view of a conventional 2-stroke engine is shown in FIG. 1. The conventional engine includes a crank shaft A to which is secured a pair of crank counter weights B and B'. A connecting rod C is rotatably secured to the counter weights B and B' with a pin D. The connecting rod C connects the crank shaft A with a piston E reciprocally moving with an upstroke and a downstroke into a combustion chamber F.

Figure 4:
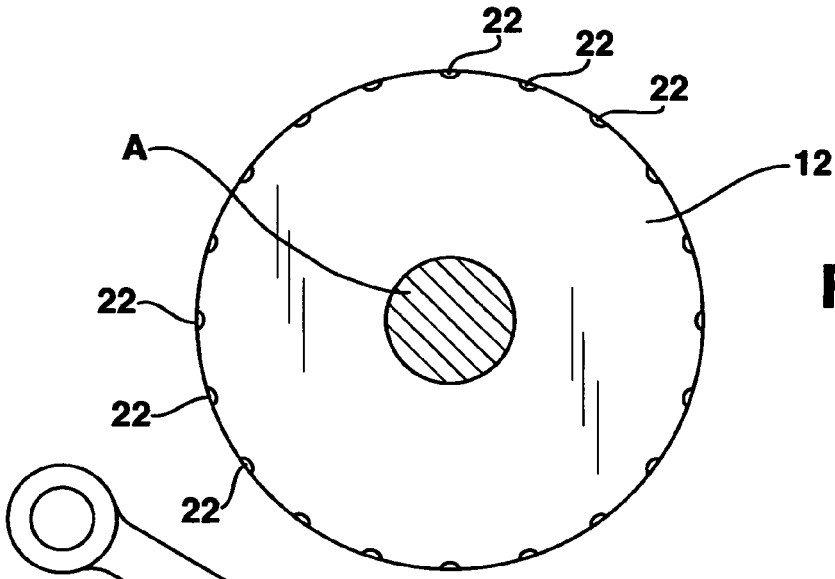
FIG. 4 is a rear elevation view of the crank counterweight shown in FIG. 3.
Figure 3:
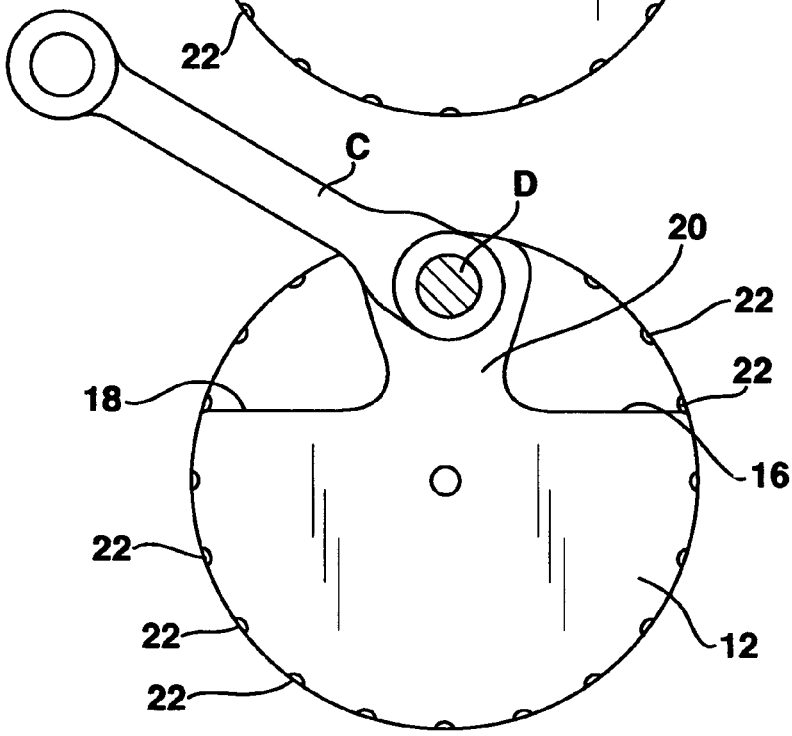
FIG. 3 is a cross-sectional view taken along the line 3-3 in FIG. 2.
Figure 2:
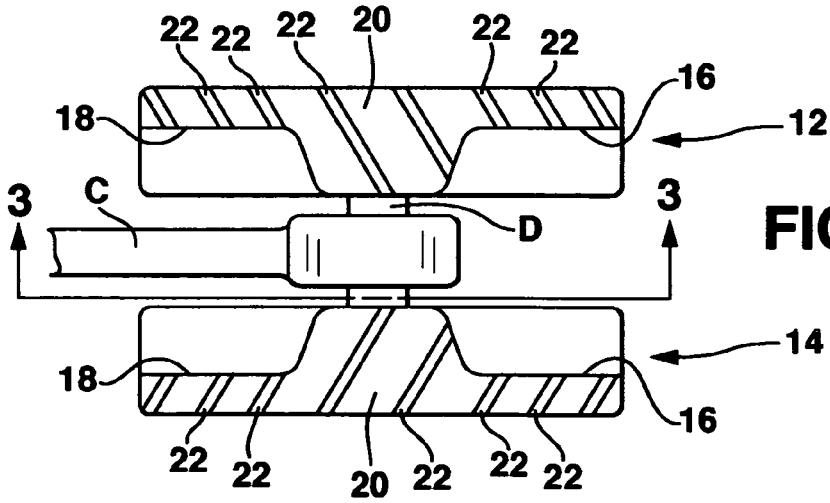
FIG. 2 is a top view of a pair of crank counter weights which have been modified according to the present invention.

The present invention 10 is shown in FIGS. 2, 3 and 4. The present invention 2 includes a pair of crank counter weights 12 and 14 secured to the crank shaft A for rotating with the crank shaft in a direction of rotation. The counter weights 12 and 14 replace the conventional counter weights B and B' shown in FIG. 1.

An elevational view of the counter weight 12 is shown in FIGS. 3 and 4. Each of the counter weights 12 and 14 have a disk wheel shape having a rim 15. Each of the counter weights 12 and 14 have a pair of cutouts 16 and 18, leaving a boss 20 a shown in FIGS. 2 and 3. The boss 20 of counter weights 12 and 14 support a pin D for rotatably supporting connecting rod C to the counter weights 12 and 14.

The rim 15 of counter weight 12 has a series of parallel disposed grooves 22 as shown in FIG. 2 which are arranged continuously around the circumferences of the disk wheel and extend from the outer edge of the rim to an inner edge of the rim. The grooves 22 are angularly disposed with respect to an axis of rotation of the crank shaft and directed against the direction of rotation.

Similarly the counter weight 14 has cutout portions 16 and 18 leaving a boss 20. The rim 15 of counterweight 14 has a series of parallel disposed peripheral grooves 24 which are arranged continuously around the circumference of the disk wheel and extend from an outer edge of the rim to the inner edge of the rim. The grooves 24 are angularly disposed with respect to the axis of rotation of the crankshaft and directed against the direction of rotation.

Each of the grooves 22 is aligned with each of the grooves 24 whereby the corresponding grooves form a generally truncated "V" configuration on the rims 15 of counter weights 12 and 14 as shown in FIG. 2.

Figure 5:
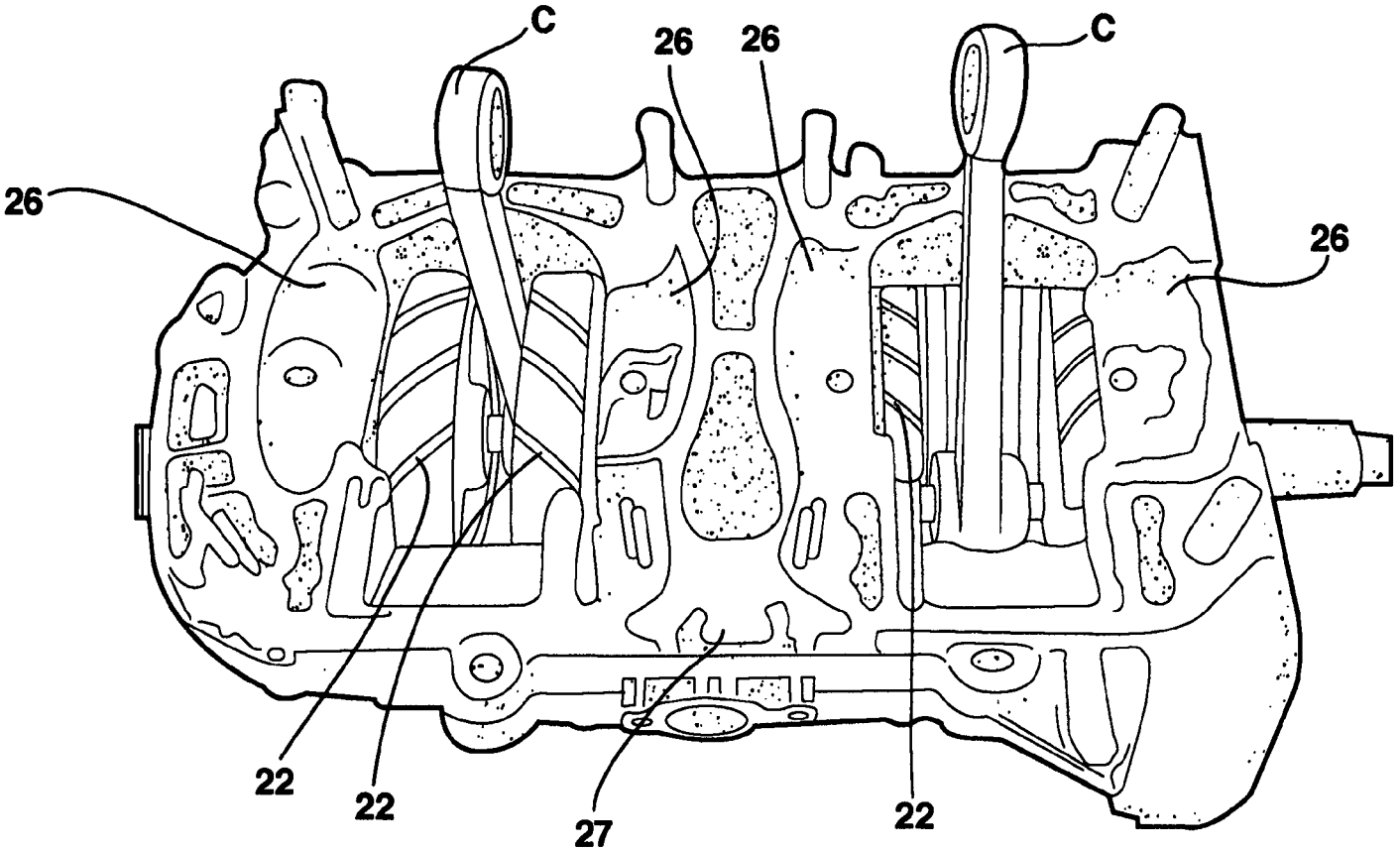
FIG. 5 is a photograph of the present invention mounted in a 2 cylinder, 2-stroke engine with parts removed.

When the counter weights 12 and 14 are substituted for the counter weights B and B' in a conventional 2 cycle engine, the fuel charge from a carburetor (not shown) flows into an engine crank case 27 and is caught and tangentially thrown outwardly toward transfer ports 26, shown in FIG. 5, provided in the crank case 27. The grooves 22 and 24 are disposed continuously around the exterior surface of the counter weights 12 and 14, thus the fuel charge from the crank case 27 is continuously thrown toward the transfer ports 26. With this arrangement, fuel efficiency, power and smooth operation is significantly enhanced.

While the fundamental novel features of the invention have been shown and described, it should be understood that various substitutions, modifications, and variations may be made by those skilled in the arts, without departing from the spirit or scope of the invention. Accordingly, all such modifications or variations are included in the scope of the invention as defined by the following claims:

I claim:

1. A two-cycle internal combustion engine comprising:

a combustion chamber;

a closed crank case;

a piston disposed between the combustion chamber and the crankcase and arranged for reciprocal movement;

a crank shaft disposed within the crankcase for rotation about an axis of rotation;

a first and second counter weights fixedly secured to the crank shaft for rotatable movement with the crankshaft in the direction of rotation;

a connecting rod connecting the piston at an eccentric point on the first and second counterweights whereby the reciprocal downstroke and upstroke movements of the piston cause rotational movement of the crankshaft;

each of the first and second counterweights having cutaway portions on one side of the axis of rotation leaving a boss to which the connecting rod is rotatably connected;

each of the first and second counterweights comprised of a disk wheel having a rim with an outer edge and an inner edge;

the rim of the first counterweight provided with a plurality of parallel first grooves arranged continuously around the circumference of said disk wheel rim and each extending from the outer edge of said rim to the inner edge of said rim;

the first grooves angularly disposed with respect to the axis of rotation in a direction against the direction of rotation;

the rim of the second counterweight provided with a plurality of parallel second grooves arranged continuously around the circumference of said disk wheel rim and extending from the outer edge of said rim to the inner edge of said rim;

the second grooves angularly disposed with respect to the axis of rotation in a direction against the direction of rotation;

each of said first grooves of the first counterweight aligned with each of said second grooves of the second counterweight whereby the corresponding grooves form a "V" configuration;

a transfer port establishing fluid communication between the combustion chamber and crankcase;

means for directing a fuel/air mixture to the interior of the crankcase;

the transfer port and first and second counterweights being so disposed and arranged that the grooves of the first and second counterweights tangentially throw the fuel/air mixture into the transfer port.

* * * * *